US011795810B2

(12) United States Patent
Safar et al.

(10) Patent No.: US 11,795,810 B2
(45) Date of Patent: Oct. 24, 2023

(54) FLARE SYSTEMS ANALYZER

(71) Applicant: Saudi Arabian Oil Company, Dhahran (SA)

(72) Inventors: Anas H. Safar, Dhahran (SA); Mohammed A. Al-Mahmood, Dhahran (SA); Yousef D. Aloufi, Dhahran (SA); Abdullmajeed I. Al Sanad, Dhahran (SA); Mohammed A. Aljallal, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 222 days.

(21) Appl. No.: 17/486,004

(22) Filed: Sep. 27, 2021

(65) Prior Publication Data

US 2023/0094678 A1 Mar. 30, 2023

(51) Int. Cl.

| | |
|---|---|
| ***E21B 47/07*** | (2012.01) |
| ***E21B 47/003*** | (2012.01) |
| ***E21B 47/12*** | (2012.01) |
| ***E21B 41/00*** | (2006.01) |
| ***F23G 5/50*** | (2006.01) |

(52) U.S. Cl.

CPC ..... *E21B 47/07* (2020.05); *E21B 41/0071* (2013.01); *E21B 47/003* (2020.05); *E21B 47/138* (2020.05); *F23G 5/50* (2013.01)

(58) Field of Classification Search

CPC ..... E21B 47/07; E21B 47/003; E21B 47/138; E21B 47/0071; F23G 5/50

USPC ..... 431/5, 202

See application file for complete search history.

(56) References Cited

U.S. PATENT DOCUMENTS

| | | | |
|---|---|---|---|
| 4,202,168 | A | 5/1980 | Acheson et al. |
| 8,967,995 | B1 | 3/2015 | Griffin et al. |
| 10,029,291 | B2 | 7/2018 | Fischer et al. |
| 2003/0069743 | A1 | 4/2003 | Nordrum |
| 2010/0070404 | A1 | 3/2010 | McConnell |

(Continued)

FOREIGN PATENT DOCUMENTS

| | | |
|---|---|---|
| EP | 2309186 | 4/2011 |
| EP | 2330347 | 6/2011 |

OTHER PUBLICATIONS

Engineering Data Book, The Gas Processor Suppliers Association (GPSA), 12th Edition, vol. 1, Chapter 5: Relief Systems, 2004, 25 pages.

(Continued)

*Primary Examiner* — Vivek K Shirsat

(74) *Attorney, Agent, or Firm* — Fish & Richardson P.C.

(57) ABSTRACT

Systems and methods include a computer-implemented method for real-time flare network monitoring. Real-time flaring volume data is received from relief devices connected to a flare network. The real-time flaring volume data is analyzed in conjunction with heat and material balance information of the relief devices. A comprehensive molar balance is performed based on the analyzing, the balancing including losses/feed percentages for each component of the flare network including the relief devices throughout the flare network. Flaring data for the components is aggregated for each flare header. Real-time flare network monitoring information, including instantaneous component-wise flaring for each flare header in the flare network is provided for display to a user in a user interface.

20 Claims, 8 Drawing Sheets

(56) References Cited

U.S. PATENT DOCUMENTS

| | | | | |
|---|---|---|---|---|
| 2014/0266740 | A1 | 9/2014 | Fernandes et al. | |
| 2015/0260397 | A1 | 9/2015 | Talasila et al. | |
| 2017/0370579 | A1* | 12/2017 | Johnson | F23G 7/065 |
| 2019/0242575 | A1* | 8/2019 | Fisher | F23L 7/005 |
| 2019/0366400 | A1* | 12/2019 | Chambers | E21B 41/0071 |
| 2021/0372864 | A1* | 12/2021 | Tao | G01K 17/06 |
| 2023/0096405 | A1 | 3/2023 | Safar et al. | |
| 2023/0128460 | A1 | 4/2023 | Safar et al. | |

OTHER PUBLICATIONS

Sick, "Flowsic100 Flare: Reliable gas flow measurement in flare gas applications," Oct. 2021, retrieved Jul. 13, 2022, retrieved from URL <https://www.bakerhughesds.com/panametrics/sensors-probes-transducers-transmitters/oil-and-gas/panametrics-flare>, 5 pages.

PCT International Search Report and Written Opinion in International Appln. No. PCT/US2022/077028, dated Jan. 23, 2023, 12 pages.

bakerhughesds.com [online], "Flare gas measurement & control solutions," 2021, retrieved Aug. 9, 2021 from URL<https://www.bakerhughesds.com/panametrics/flare-management>, 11 pages.

Boneu et al., "How and when to monitor a patient treated with low molecular weight Heparin," Seminars in Thrombosis and Hemostasis, Oct. 2001, 27(5):519-522, 4 pages.

Compendium of Greenhouse Gas Emissions Methodologies for the Oil and Natural Gas Industry, American Petroleum Institute, Aug. 2009, 807 pages.

Eddleman et al., "Flare monitoring regulatory compliance and analyzers: An analysis," Yokogawa, 2018, 4 pages.

Gilmer et al., "Draft flare waste gas flow rate and composition measurement methodologies evaluation document," Texas Commission on Environmental Quality, Work Assignment 5, Shell Global Solutions, available on or before Jun. 2013 via Internet Archive Wayback Machine URL <https://web.archive.org/web/20131101000000*/https://www.tceq.texas.gov/assets/public/implementation/air/am/contracts/reports/oth/FLARE_WASTE_GAS_FLOW_RATE.pdf>, 141 pages.

Mandatory Greenhouse Gas Reporting, 40 CFR § 98, Chapter I, Subchapter C, Oct. 2009, 581 pages.

Moorman et al., "Lower heating value sensor for fuel monitoring," IEEE Sensors, 2005, 802-805.

sick.com [online], "Gas flow measuring instruments FLOWSIC100 Flare," 2021, retrieved Aug. 9, 2021 from URL<https://www.sick.com/th/en/flow-measurement-technology/gas-flow-measuring-instruments/flowsic100-flare/c/g198253>, 7 pages.

thermofisher.com [online], "Flare stack emission monitoring," Available on or before May 4, 2021, via Internet Archive Wayback Machine URL <https://web.archive.org/web/20210420073913/https://www.thermofisher.com/us/en/home/industrial/manufacturing-processing/flare-stack-emission-monitoring.html>, retrieved on Oct. 12, 2021, retrieved from URL <https://www.thermofisher.com/sa/en/home/industrial/manufacturing-processing/flare-stack-emission-monitoring.html>, 4 pages.

Zeng et al., "Validation of a new method for measuring and continuously monitoring the efficiency of industrial flares," Journal of the Air & Waste Management Association, 2016, 66(1):76-86, 12 pages.

Umukoro et al., "Modelling emissions from natural gas flaring," Journal of King Saud University—Engineering Sciences, 2017, 29:178-182, 5 pages.

PCT International Search Report and Written Opinion in International Appln. No. PCT/US2022/077030, dated Jan. 30, 2023, 14 pages.

PCT International Search Report and Written Opinion in International Appln. No. PCT/US2022/078596, dated Feb. 2, 2023, 15 pages.

* cited by examiner

200

| FLARING COMPOSITIONS | | | |
|---|---|---|---|
| COMPONENTS | SOUR HEADER | SWEET HEADER | OVERALL |
| H2O | 2.90% | 2.24% | 2.24% |
| H2S | 9.15% | 0.00% | 0.00% |
| NH3 | 3.31% | 0.00% | 0.00% |
| H2 | 50.64% | 58.43% | 58.43% |
| C1 | 18.24% | 21.04% | 21.04% |
| C2 | 10.91% | 12.39% | 12.39% |
| C3 | 2.18% | 2.51% | 2.51% |
| IC4 | 0.02% | 0.05% | 0.05% |
| NC4 | 2.47% | 3.06% | 3.06% |
| IC5 | 0.00% | 0.06% | 0.06% |
| NC5 | 0.00% | 0.09% | 0.09% |
| C5+ | 0.17% | 0.12% | 0.12% |
| NC6 | 0.00% | 0.00% | 0.00% |
| C-C6 | 0.00% | 0.00% | 0.00% |
| BENZE | 0.00% | 0.00% | 0.00% |
| N-C7 | 0.00% | 0.00% | 0.00% |
| N2 | 0.00% | 0.00% | 0.00% |
| 202 | 204 | 206 | 208 |

FIG. 2

| Date | HC Flaring | N-HC Flaring | Total Flaring |
|---|---|---|---|
| 9/10/2020 | 329.68 | 526.34 | 856.02 |
| 9/11/2020 | 324.08 | 517.18 | 841.25 |
| 9/12/2020 | 337.51 | 537.87 | 875.37 |
| 9/13/2020 | 339.65 | 541.91 | 881.56 |
| 9/14/2020 | 317.70 | 511.76 | 829.45 |
| 9/15/2020 | 421.67 | 715.93 | 1,137.61 |
| 9/16/2020 | 387.83 | 692.55 | 1,080.38 |
| 9/17/2020 | 351.90 | 555.45 | 907.34 |
| 9/18/2020 | 306.28 | 499.03 | 805.30 |
| 9/19/2020 | 290.27 | 474.62 | 764.88 |
| 9/20/2020 | 302.21 | 485.31 | 787.52 |
| 9/21/2020 | 297.20 | 482.23 | 779.43 |
| **Total** | 106,449.44 | 193,650.53 | 300,100.28 |

FLARE SYSTEMS ANALYZER

TECHNICAL FIELD

The present disclosure applies to monitoring and controlling flare systems.

BACKGROUND

Flare systems include gas flares (or flare stacks) that provide gas combustion at industrial plants such as at onshore and offshore oil and gas production sites. Flare systems can provide venting during start-up or shut-down, and for handling emergency releases from safety valves, blow-down, and de-pressuring systems.

SUMMARY

The present disclosure describes techniques that can be used for monitoring and controlling flare systems. In some implementations, a computer-implemented method includes the following. Real-time flaring volume data is received from relief devices connected to a flare network. The real-time flaring volume data is analyzed in conjunction with heat and material balance information of the relief devices. A comprehensive molar balance is performed based on the analyzing, the balancing including losses/feed percentages for each component of the flare network including the relief devices throughout the flare network. Flaring data for the components is aggregated for each flare header. Real-time flare network monitoring information, including instantaneous component-wise flaring for each flare header in the flare network is provided for display to a user in a user interface.

The previously described implementation is implementable using a computer-implemented method; a non-transitory, computer-readable medium storing computer-readable instructions to perform the computer-implemented method; and a computer-implemented system including a computer memory interoperably coupled with a hardware processor configured to perform the computer-implemented method, the instructions stored on the non-transitory, computer-readable medium.

The subject matter described in this specification can be implemented in particular implementations, so as to realize one or more of the following advantages. The life stream of each flare header can be measured and monitored, which can help in: reducing combustible fluid losses (de-carbonization), improving the accuracy of emissions calculations for sulfur dioxide ($SO_2$), nitrogen dioxide $NO_2$, carbon dioxide ($CO_2$), and methane ($CH_2$), and improving overall plant mass balance (losses/feed percentage). The techniques of the present disclosure can provide non-intrusive an cost-effective instantaneous estimations of the flare system compositions without incurring capital expenditures (CAPEX) or operational expenditures (OPEX) costs. The techniques of the present disclosure can provide a comprehensive system with detailed performance equations that can assist in identifying flaring components. The techniques of the present disclosure can overcome conventional systems that have limitations on the measuring range and that require frequent calibration and maintenance. The techniques of the present disclosure provide an advantage over conventional systems (with conventional instrumented equipment) by being non-intrusive and by not requiring a change to the operating facilities or shutdown, while requiring zero capital expenditures (CAPEX) and operating expenditures (OPEX). The details of one or more implementations of the subject matter of this specification are set forth in the Detailed Description, the accompanying drawings, and the claims. Other features, aspects, and advantages of the subject matter will become apparent from the Detailed Description, the claims, and the accompanying drawings.

DESCRIPTION OF DRAWINGS

FIG. 2 is table showing examples of flaring compositions values, according to some implementations of the present disclosure.

Like reference numbers and designations in the various drawings indicate like elements.

DETAILED DESCRIPTION

Figure 1:
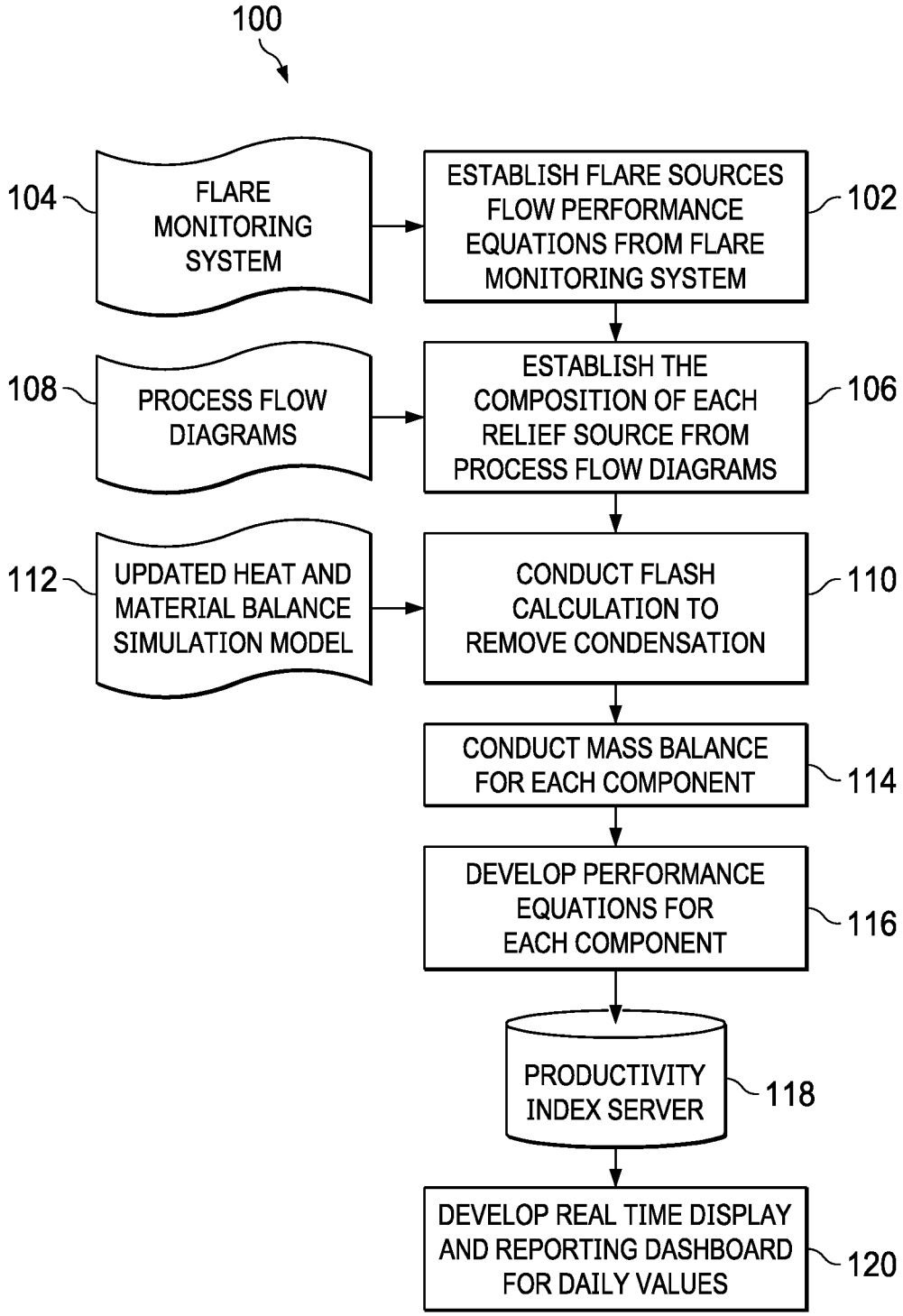
FIG. 1 is flow diagram showing an example workflow for generating a real-time display, according to some implementations of the present disclosure.

The following detailed description describes techniques for monitoring and controlling flare systems. Various modifications, alterations, and permutations of the disclosed implementations can be made and will be readily apparent to those of ordinary skill in the art, and the general principles defined may be applied to other implementations and applications, without departing from scope of the disclosure. In some instances, details unnecessary to obtain an understanding of the described subject matter may be omitted so as to not obscure one or more described implementations with unnecessary detail and inasmuch as such details are within the skill of one of ordinary skill in the art. The present disclosure is not intended to be limited to the described or illustrated implementations, but to be accorded the widest scope consistent with the described principles and features.

A flare systems analyzer system can provide the capability to compute actual flaring composition for each header of a flare and relief network. The system can receive real-time data from a processing facility's flaring volumes. For example, the term real-time can correspond to events that occur within a specified period of time, such as within a few minutes. The real-time data can be analyzed in conjunction with the heat and material balance of the processing facilities and the volumetric flowrate of each relief source connected to the flare system. The resulting information can be used to perform a comprehensive molar balance for each flare component throughout the flare network. The results of the analysis can be provided to operators in the form of reports that indicate the average daily flaring for each component. A real-time display can be provided to track the composition of flaring for each flare header. This can aid operators in reducing combustible fluid losses due to flaring, improve the accuracy of emissions calculations for sulfur dioxide ($SO_2$), nitrogen dioxide $NO_2$, carbon dioxide ($CO_2$), and methane ($CH_2$), and improve the overall plant mass balance (including losses/feed percentage). The techniques can be used in systems that provide or support flare and relief system operations, emission monitoring, management of hydrocarbon losses, and flaring minimization. The techniques can aid operator in conducting a thorough analysis of flaring events as the composition is known. The operators can provide information and analysis to adjust and optimize purge gas rates and calibrate flare flow meters. For example, optimizing can refer to achieving purge gas rates or calibration of flare flow meters within a pre-defined threshold level of performance or within a specific range of key process indicators (KPIs). The techniques can improve the accuracy in reporting emission figures.

In some implementations, development of a flare system analyzer includes the following. A volumetric flowrate of each relief source from the flare network monitoring system can be used. A plant's latest process flow diagram can be reviewed and studied in order to obtain the discharge composition of each relief source connected to the flare network. Flash calculations can be conducted using an updated heat and material balance model to remove any condensation and to obtain accurate relief composition. The flash calculations can be conducted by reducing the relief source stream pressure to atmospheric pressure. As a result, the temperature of the stream can also be reduced by 10 degrees Celsius (° C.).

Mass balance for each component can be conducted, starting from the device level all the way to the header, using the following equation:

$$N_i=\Sigma_{i=1}^{n}(Xi_1\times V_1+Xi_2\times V_2\ldots)/C \quad (1)$$

where $N_i$=a total molar flow of component (i) at each flare header (e.g., in pound-moles per day (lb-mole/d)), V=a volumetric flow rate of the relief source obtained from a flare monitoring system (FMS), $X_i$=a mole fraction of component (i) at the relief source, and constant C=379.3 standard cubic foot (scf)/lb-mole, which is the standard molar volume at 14.7 pounds per square inch absolute (psia) and 60 degrees Fahrenheit (° F.). A performance equation (PI expiration) can be developed using the above equation. Productivity index (PI) tags can be created on a PI server. The PI tags can be used in a real-time display of the facility and the monitoring dashboard to illustrate and monitor the actual flaring composition.

FIG. 1 is flow diagram showing an example workflow 100 for generating a real-time display, according to some implementations of the present disclosure. At 102, flare sources flow performance equations are established from FMS 104. At 106, the composition of each relief source is established from process flow diagrams (PFD) 108. At 110, flash calculations are conducted to remove condensation. The calculations can be made using an updated heat and material balance simulation model 112. At 114, mass balance is conducted for each component. At 116, performance equations are developed for each component and stored on a PI server 118. At 120, a real-time display and reporting dashboard is developed, using the PI server 118, to display daily values.

FIG. 2 is table 200 showing examples of flaring compositions values, according to some implementations of the present disclosure. For each component 202, a sour header percentage 204, a sweet header percentage 206, and an overall percentage 208 are listed in table 200.

Figure 3:
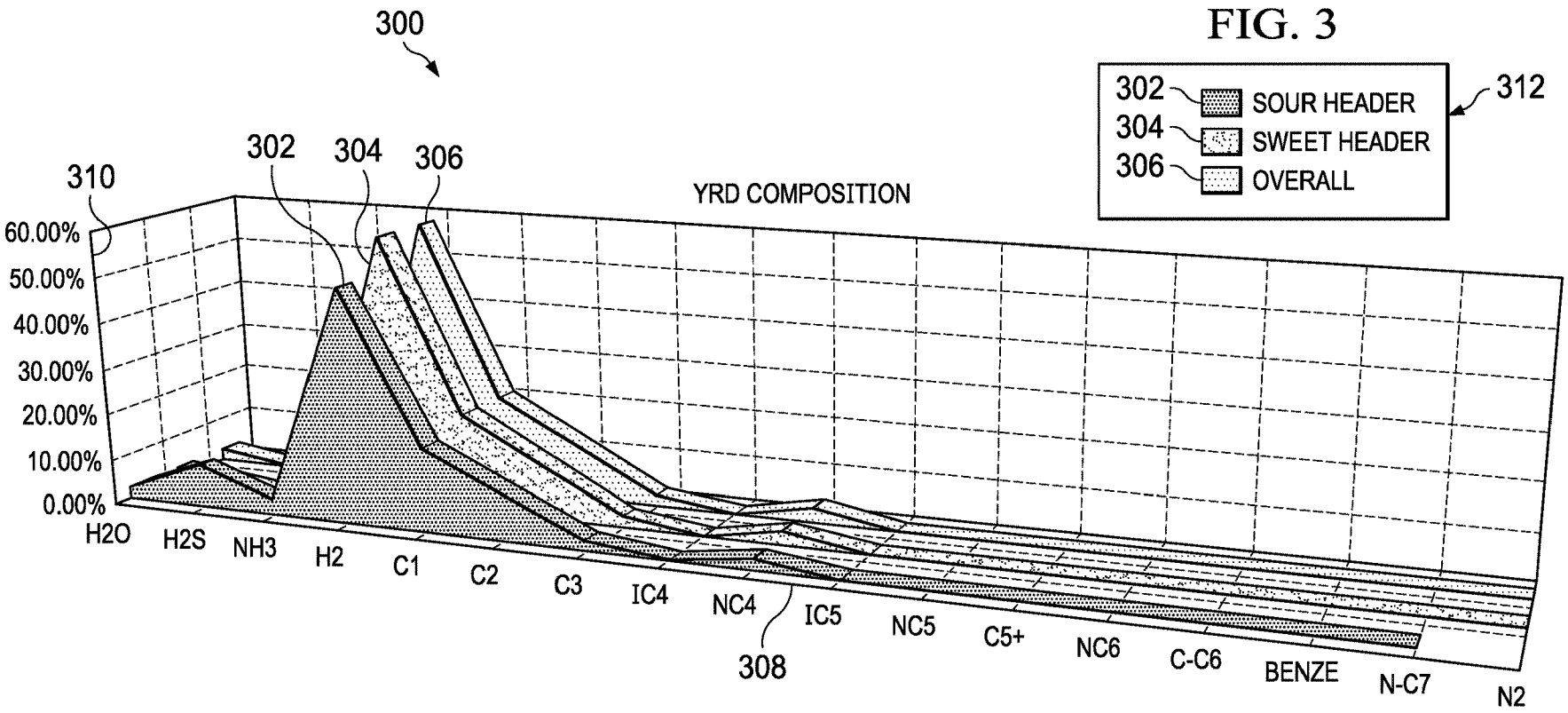
FIG. 3 is a graph showing examples of plotted values for Yellow River Delta (YRD) composition, according to some implementations of the present disclosure.

FIG. 3 is a graph 300 showing examples of plotted values for Yellow River Delta (YRD) composition, according to some implementations of the present disclosure. The values plotted in the graph 300 can correspond, for example, the values in table 200. Plots in the graph 300 include sour header percentage 302, sweet header percentage 304, and overall percentage 306. The plots in the graph 300 are plotted relative to a molecules axis 308 (e.g., corresponding to components 202) and a percentage axis 310.

Figure 4:
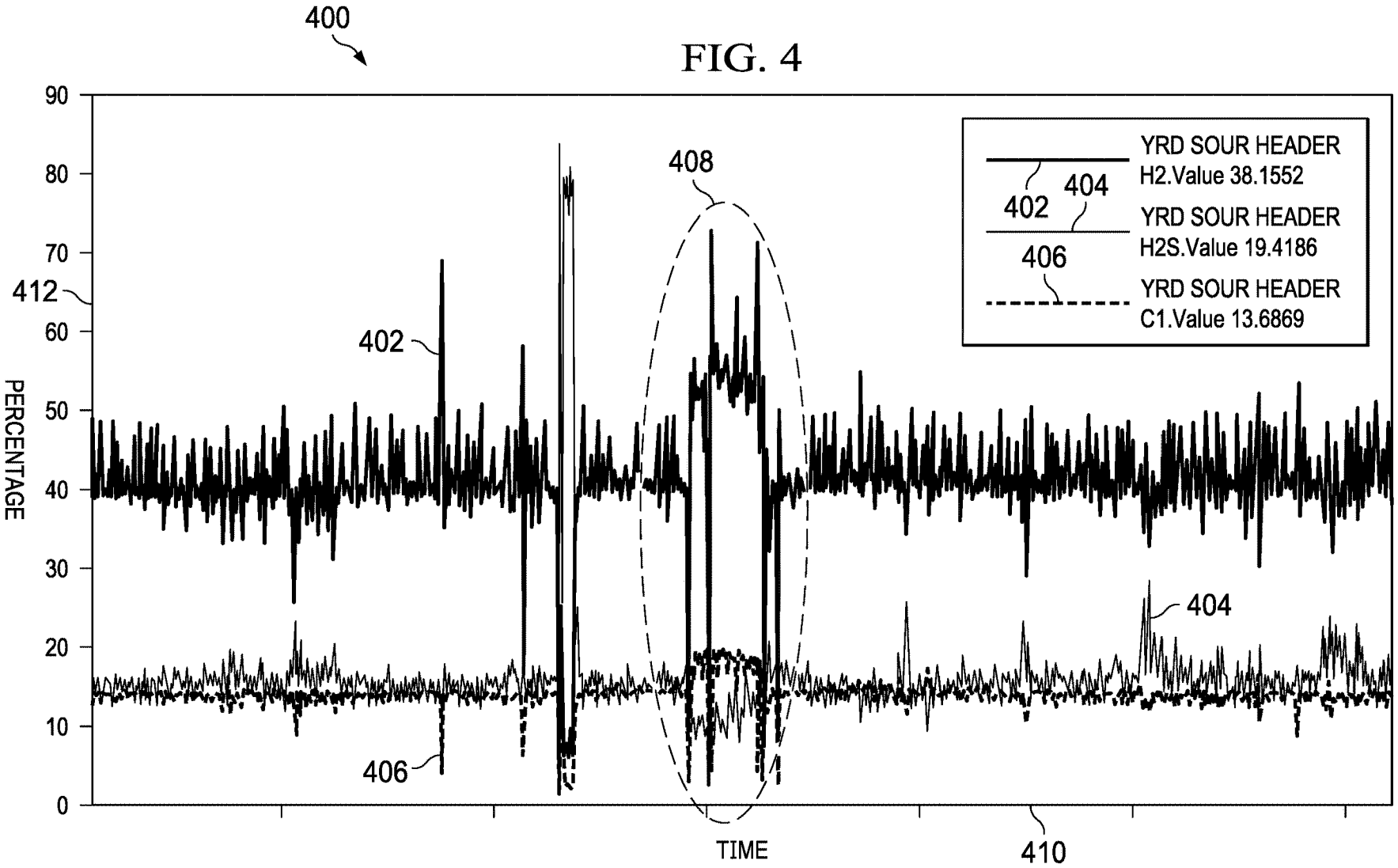
FIG. 4 is a graph showing example sour header values over time, according to some implementations of the present disclosure.

FIG. 4 is a graph 400 showing example sour header values over time, according to some implementations of the present disclosure. For example, the graph shows YRD sour header dihydrogen ($H_2$) values 402, YRD sour header Hydrogen sulfide ($H_2S$) values 404, and YRD sour header methane (C1) values 406. Region 408 on the graph shows a time period during which a fluctuation occurs the sour header values. Plots on the graph 400 are plotted relative to a time axis 410 and a percentage axis 412.

Figure 5:
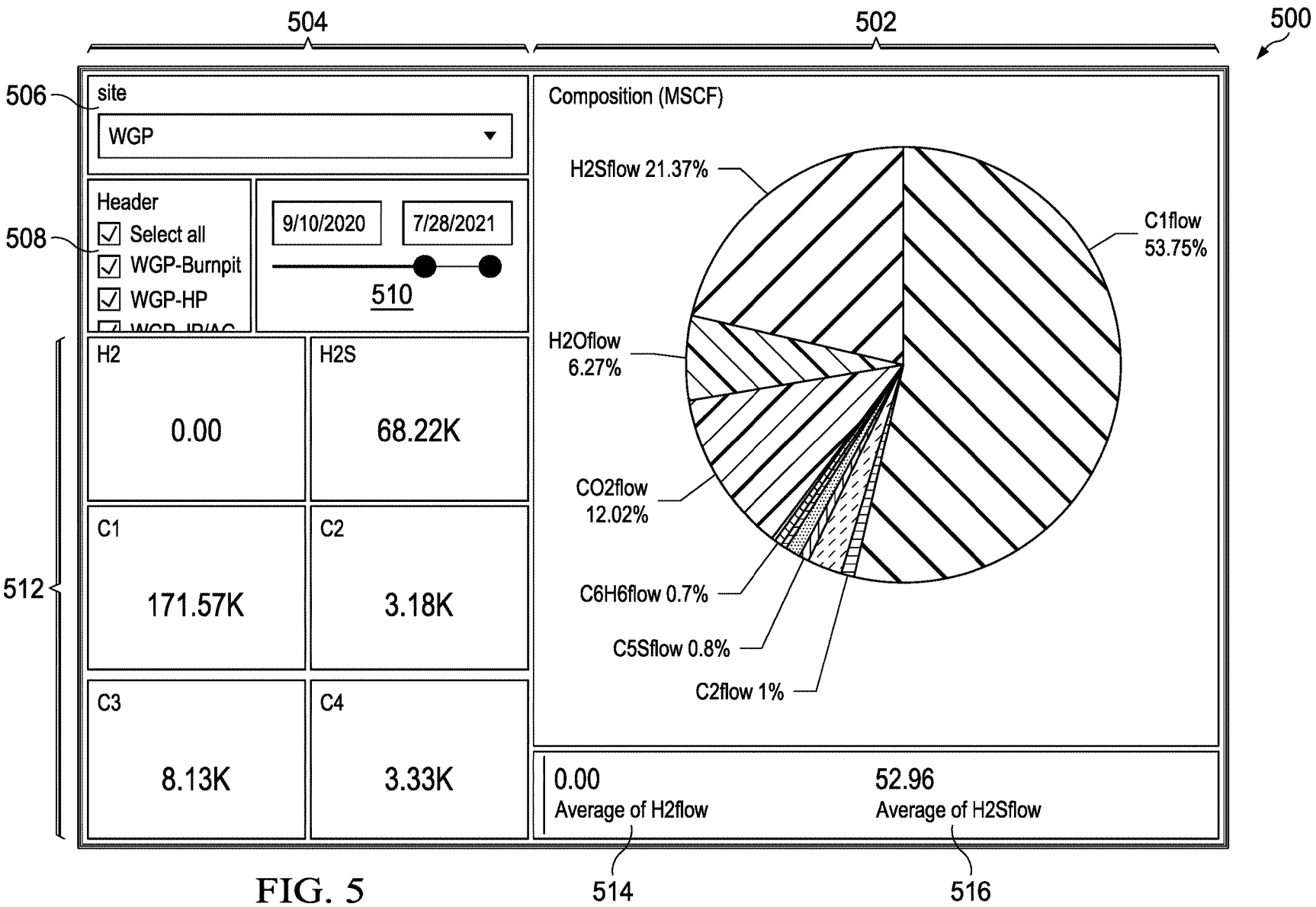
FIG. 5 is a screenshot showing an example of a user interface for displaying composition information, according to some implementations of the present disclosure.

FIG. 5 is a screenshot showing an example of a user interface 500 for displaying composition information, according to some implementations of the present disclosure. The user interface 500 includes a graph area 502 and an alpha-numeric area 504. A dropdown list 506 lists operating facilities that users can select to view the results. The dropdown list 506 is generated based on mapping each individual operating facility with a unique site ID. A flare header names area 508 identifies flare headers in a selected operating facility from which users can select one or multiple headers to drilldown into the results. Flare headers can also be mapped with a unique identifier (ID) (for example, a header ID) that is mapped with the respective operating facility. A control 510 identifies a timeline which users can select to display results pertaining to a time period. Users can select a single or multiple days. A section 512 illustrates the magnitude of flaring for each gas component, including methane, hydrogen, ethane, and/or hydrogen sulfide, for example, for the selected operating facility and timeframe. A value 514 indicates an average flaring value of hydrogen for the selected operating facility and timeframe. A value 516 indicates an average flaring value of hydrogen sulfide for the selected operating facility and timeframe.

Figure 6:
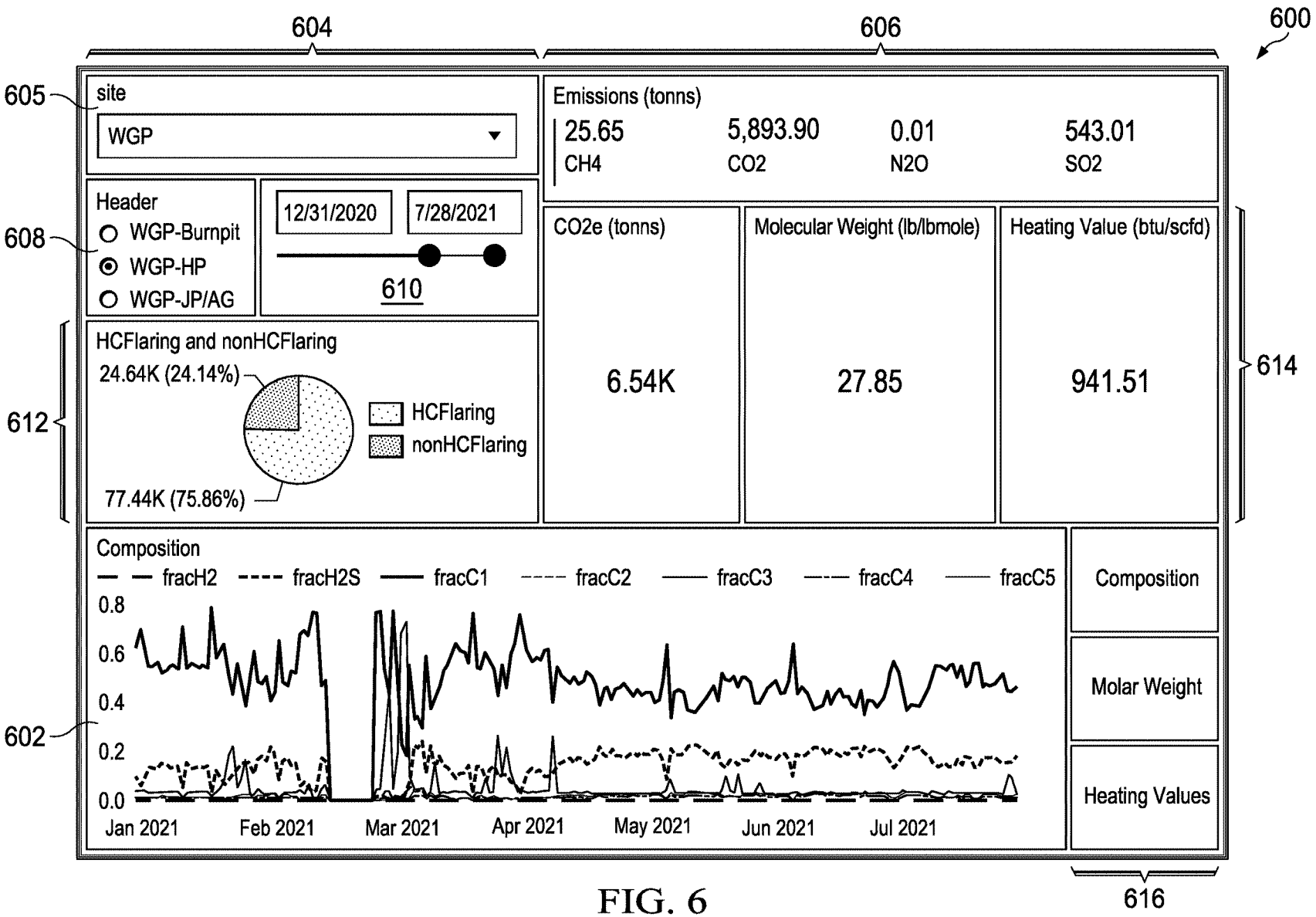
FIG. 6 is a screenshot showing an example of a user interface for displaying composition information, according to some implementations of the present disclosure.

FIG. 6 is a screenshot showing an example of a user interface 600 for displaying composition information, according to some implementations of the present disclosure. Graph 602 demonstrates a daily trend of the flaring composition for the selected operating facility and header. Region 604 includes a dropdown list of operating facilities that users can select to view the results. The dropdown list is based on mapping each individual operating facility with a unique site ID (for example, mappings can be database mappings). Field 605 is a field that users can use to select a site for which to display the data in the user interface. Region 606 includes a display of the cumulative values of emissions for the selected operating facility, header, and timeframe. The emissions can include, for example, methane, carbon dioxide, nitrogen oxide, and sulfur dioxide. Region 608 illustrates flare header names for a selected operating facility from which users can select a single header to drill down into the results. Flare headers are also mapped with a unique ID (for example, header ID) mapped with the respective operating facility. Control 610 shows a timeline in which users can select for the results to appear. Users can select a single or multiple day. Region 612 shows the hydrocarbon to non-hydrocarbon flaring in graphical format for the selected operating facility and header. Region 614 shows the average heating value, molecular, weight and carbon dioxide equivalent for the selected operating facility, header, and timeframe. Region 616 includes navigation buttons in which uses can display the daily trend of the selected parameters including the flaring composition.

Figure 7:
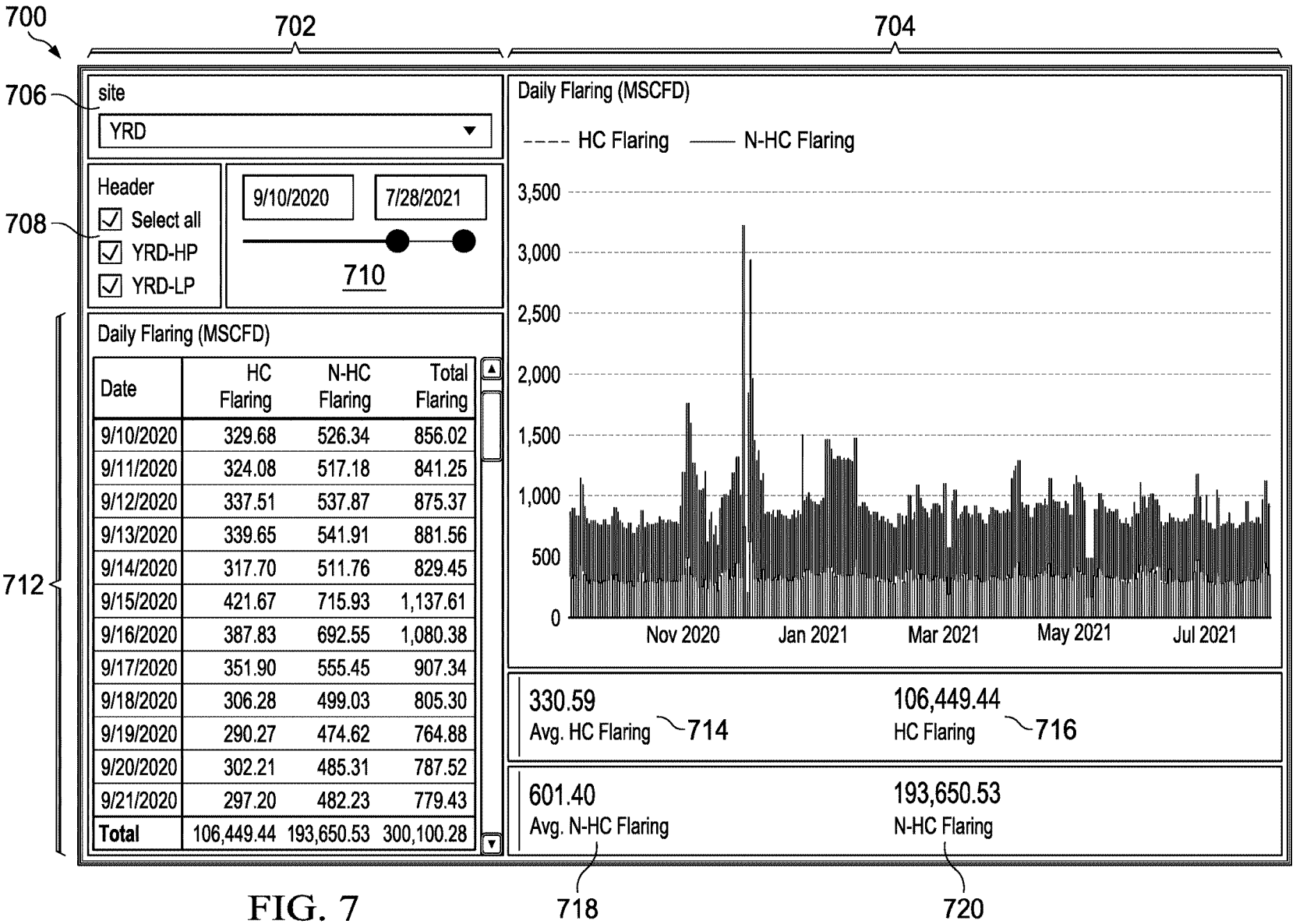
FIG. 7 is a screenshot showing an example of a user interface for displaying composition information, according to some implementations of the present disclosure.

FIG. 7 is a screenshot showing an example of a user interface 700 for displaying composition information, according to some implementations of the present disclosure. The user interface 700 includes a data selection/display area 702 and a graph area 704. Region 706 includes a dropdown list 706 of operating facilities that users can select to view the results. The dropdown list 706 can be generated based on a mapping of each individual operating facility with a unique site ID. Region 708 displays the flare header names for the selected operating facility from which users can select one or multiple headers to drill down into the results. Flare headers can also be mapped with a unique ID (for example, header ID), mapped with the respective operating facility. Control 710 displays a timeline for which users can select for the results to appear. Users may select a single day or multiple days. Region 712 displays daily values of the hydrocarbon flaring, non-hydrocarbon flaring, and total flaring in table format. Users can also extract (or export) the table for further use. Display 714 shows the average value of hydrocarbon flaring for the selected operating facility and timeframe. Display 716 shows the total value of hydrocarbon flaring for the selected operating facility and timeframe. Display 718 shows the average value of non-hydrocarbon flaring for the selected operating facility and timeframe. Display 720 shows the total value of non-hydrocarbon flaring for the selected operating facility and timeframe.

Figure 8:
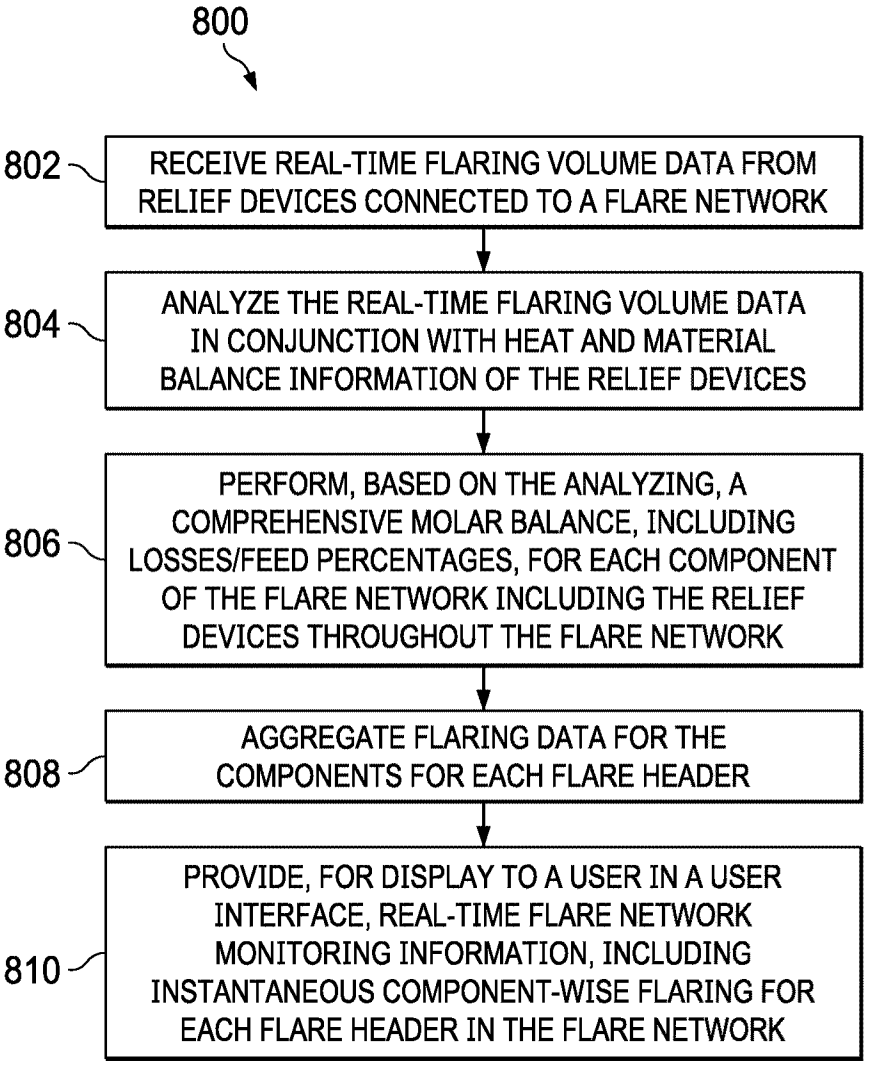
FIG. 8 is a flowchart showing an example of a method for monitoring and controlling flare systems, according to some implementations of the present disclosure.

FIG. 8 is a flowchart showing an example of a method 800 for monitoring and controlling flare systems, according to some implementations of the present disclosure. For clarity of presentation, the description that follows generally describes method 800 in the context of the other figures in this description. However, it will be understood that method 800 can be performed, for example, by any suitable system, environment, software, and hardware, or a combination of systems, environments, software, and hardware, as appropriate. In some implementations, various steps of method 800 can be run in parallel, in combination, in loops, or in any order.

At 802, real-time flaring volume data is received from relief devices connected to a flare network. As an example, flaring data can be received from an onshore or offshore oil or gas production sites. From 802, method 800 proceeds to 804.

At 804, the real-time flaring volume data is analyzed in conjunction with heat and material balance information of the relief devices. As an example, flaring data received from the onshore or offshore oil or gas production site can be analyzed as follows. The volumetric flowrate of each relief sources is combined with the stream compositions from the heat and material balance of the source equipment and/or lab sample results. A flash calculation is then conducted on that stream to remove any condensation and to obtain accurate relief composition. The flash calculation is basically conducted by reducing the relief source stream pressure to atmospheric pressure, reducing the temperature by 10 degrees Celsius (° C.). This step is done for all relief sources of the flare network. The compositions obtained from the flash calculations are then stored in the data base to be utilized further in the mas balance equation as in 806. From 804, method 800 proceeds to 806.

At 806, a comprehensive molar balance is performed based on finalized compositions obtained in step 804, losses/feed percentages, and flaring volumes. The molar balance is conducted for each component starting from the relief source throughout the flare network. For example, performing the comprehensive molar balance can include determining a total molar flow of a component at each flare header based on a summation of products of each component's mole fraction of the component at a relief source times a volumetric flow rate of the relief source obtained from a flare monitoring system, divided by a conversion factor to convert standard volume flow into molar flow (for example, 379.3 SCF/lb-mole).

Equation (1) can be used, for example, in a scenario in which relief sources A and B have volumetric flow rates of 100 and 50 MSCFD respectively. Assuming a composition of $H_2$=50 mole % and $CH_4$=50 mole % for relief source A, and then for relief source B: $H_2$=20 mole % and $CH_4$=80 mole %, the using Equation (1) results in:

$$N_{H_2} = \frac{\sum_{i=1}^{n} (50\% \times 100 + 20\% \times 50)}{379.3} = 0.158 \text{ lb mol} \tag{2}$$

$$N_{CH_4} = \frac{\sum_{i=1}^{n} (50\% \times 100 + 80\% \times 50)}{379.3} 0.237 \text{ lb mol} \tag{3}$$

At 808, the molar flowrate of each component are used to determine aggregated molar flowrates at each flare header. For example, if a flare header consists of ten (10) devices, in which each consent of 2 lb-mol/day of hydrogen ($H_2$), the total aggregated value of hydrogen in that header will be 20 lb-mol/day. This can be applied for the remaining components to determine the total molar flowrate for each component at each flare header.

From 808, method 800 proceeds to 810. At 810, real-time flare network monitoring information is provided for display to a user in a user interface, including displaying instantaneous component-wise flaring for each flare header in the flare network. For example, the displays described with reference to FIGS. 2-7 can be provided. The total molar flow rates of the components are then used to generate a display of daily flaring composition (per FIG. 6, element 602), hydrocarbon to non-hydrocarbon daily and total flaring (per FIG. 7), and the component wise flaring per FIG. 5. After 810, method 800 can stop.

In some implementations, method 800 further includes receiving, through the user interface, user inputs to reduce combustible fluid losses due to flaring. For example, based on flaring information (including recommendations for changes in equipment use) displayed in a user interface, users can implement the changes by approving specific changes presented on the display.

In some implementations, method 800 further includes providing, for display to the user in the user interface, real-time emissions information for sulfur dioxide ($SO_2$), nitrogen dioxide $NO_2$, carbon dioxide ($CO_2$), and methane ($CH_2$) emissions for each component of the flare network. For example, the user interface can display specific readings for the flare devices in a flaring network.

In some implementations, method 800 further includes: providing, for display to the user in the user interface, a graph displaying sour header values over time; and annotating, in the graph, time periods in which a fluctuation above a pre-determined threshold occurs the sour header values. For example, the graph 400 as described with reference to FIG. 4 can be provided.

Upon piloting this invention at a production refinery, an unexpected (high) volume of hydrogen flaring was detected at one of the flare headers. This resulted in conducting further investigation on the relief sources. The investigation results confirmed that the determined composition was valid since 61% of their purge gas flaring was hydrogen.

Figure 9:
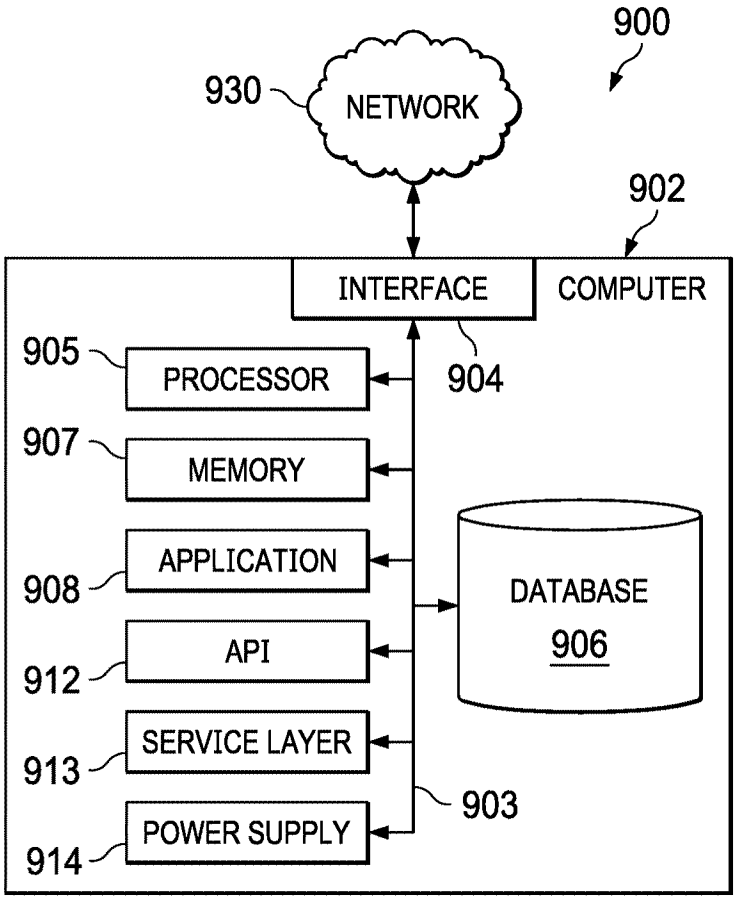
FIG. 9 is a block diagram illustrating an example computer system used to provide computational functionalities associated with described algorithms, methods, functions, processes, flows, and procedures as described in the present disclosure, according to some implementations of the present disclosure.

FIG. 9 is a block diagram showing an example computer system 900 used to provide computational functionalities associated with described algorithms, methods, functions, processes, flows, and procedures described in the present disclosure, according to some implementations of the present disclosure. The illustrated computer 902 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 902 can include input devices such as keypads, keyboards, and touch screens that can accept user information. Also, the computer 902 can include output devices that can convey information associated with the operation of the computer 902. The information can include digital data, visual data, audio information, or a combination of information. The information can be presented in a graphical user interface (UI) (or GUI).

The computer 902 can serve in a role as a client, a network component, a server, a database, a persistency, or components of a computer system for performing the subject matter described in the present disclosure. The illustrated computer 902 is communicably coupled with a network 930. In some implementations, one or more components of the computer 902 can be configured to operate within different environments, including cloud-computing-based environments, local environments, global environments, and combinations of environments.

At a top level, the computer 902 is an electronic computing device operable to receive, transmit, process, store, and manage data and information associated with the described subject matter. According to some implementations, the computer 902 can also include, or be communicably coupled with, an application server, an email server, a web server, a caching server, a streaming data server, or a combination of servers.

The computer 902 can receive requests over network 930 from a client application (for example, executing on another computer 902). The computer 902 can respond to the received requests by processing the received requests using software applications. Requests can also be sent to the computer 902 from internal users (for example, from a command console), external (or third) parties, automated applications, entities, individuals, systems, and computers.

Each of the components of the computer 902 can communicate using a system bus 903. In some implementations, any or all of the components of the computer 902, including hardware or software components, can interface with each other or the interface 904 (or a combination of both) over the system bus 903. Interfaces can use an application programming interface (API) 912, a service layer 913, or a combination of the API 912 and service layer 913. The API 912 include specifications for routines, data structures, and object classes. The API 912 can be either computer-language independent or dependent. The API 912 can refer to a complete interface, a single function, or a set of APIs.

The service layer 913 can provide software services to the computer 902 and other components (whether illustrated or not) that are communicably coupled to the computer 902. The functionality of the computer 902 can be accessible for all service consumers using this service layer. Software services, such as those provided by the service layer 913, can provide reusable, defined functionalities through a defined interface. For example, the interface can be software written in JAVA, C++, or a language providing data in extensible markup language (XML) format. While illustrated as an integrated component of the computer 902, in alternative implementations, the API 912 or the service layer 913 can be stand-alone components in relation to other components of the computer 902 and other components communicably coupled to the computer 902. Moreover, any or all parts of the API 912 or the service layer 913 can be implemented as child or sub-modules of another software module, enterprise application, or hardware module without departing from the scope of the present disclosure.

The computer 902 includes an interface 904. Although illustrated as a single interface 904 in FIG. 9, two or more interfaces 904 can be used according to particular needs, desires, or particular implementations of the computer 902 and the described functionality. The interface 904 can be used by the computer 902 for communicating with other systems that are connected to the network 930 (whether illustrated or not) in a distributed environment. Generally, the interface 904 can include, or be implemented using, logic encoded in software or hardware (or a combination of software and hardware) operable to communicate with the network 930. More specifically, the interface 904 can include software supporting one or more communication protocols associated with communications. As such, the network 930 or the interface's hardware can be operable to communicate physical signals within and outside of the illustrated computer 902.

The computer 902 includes a processor 905. Although illustrated as a single processor 905 in FIG. 9, two or more processors 905 can be used according to particular needs, desires, or particular implementations of the computer 902 and the described functionality. Generally, the processor 905 can execute instructions and can manipulate data to perform the operations of the computer 902, including operations using algorithms, methods, functions, processes, flows, and procedures as described in the present disclosure.

The computer 902 also includes a database 906 that can hold data for the computer 902 and other components connected to the network 930 (whether illustrated or not). For example, database 906 can be an in-memory, conventional, or a database storing data consistent with the present disclosure. In some implementations, database 906 can be a combination of two or more different database types (for example, hybrid in-memory and conventional databases) according to particular needs, desires, or particular implementations of the computer 902 and the described functionality. Although illustrated as a single database 906 in FIG. 9, two or more databases (of the same, different, or combination of types) can be used according to particular needs, desires, or particular implementations of the computer 902 and the described functionality. While database 906 is illustrated as an internal component of the computer 902, in alternative implementations, database 906 can be external to the computer 902.

The computer 902 also includes a memory 907 that can hold data for the computer 902 or a combination of components connected to the network 930 (whether illustrated or not). Memory 907 can store any data consistent with the present disclosure. In some implementations, memory 907 can be a combination of two or more different types of memory (for example, a combination of semiconductor and magnetic storage) according to particular needs, desires, or particular implementations of the computer 902 and the described functionality. Although illustrated as a single memory 907 in FIG. 9, two or more memories 907 (of the same, different, or combination of types) can be used according to particular needs, desires, or particular implementations of the computer 902 and the described functionality. While memory 907 is illustrated as an internal component of the computer 902, in alternative implementations, memory 907 can be external to the computer 902.

The application 908 can be an algorithmic software engine providing functionality according to particular needs, desires, or particular implementations of the computer 902 and the described functionality. For example, application 908 can serve as one or more components, modules, or applications. Further, although illustrated as a single application 908, the application 908 can be implemented as multiple applications 908 on the computer 902. In addition, although illustrated as internal to the computer 902, in alternative implementations, the application 908 can be external to the computer 902.

The computer 902 can also include a power supply 914. The power supply 914 can include a rechargeable or non-rechargeable battery that can be configured to be either user- or non-user-replaceable. In some implementations, the power supply 914 can include power-conversion and management circuits, including recharging, standby, and power management functionalities. In some implementations, the power-supply 914 can include a power plug to allow the computer 902 to be plugged into a wall socket or a power source to, for example, power the computer 902 or recharge a rechargeable battery.

There can be any number of computers 902 associated with, or external to, a computer system containing computer 902, with each computer 902 communicating over network 930. Further, the terms "client," "user," and other appropriate terminology can be used interchangeably, as appropriate, without departing from the scope of the present disclosure. Moreover, the present disclosure contemplates that many users can use one computer 902 and one user can use multiple computers 902.

Described implementations of the subject matter can include one or more features, alone or in combination.

For example, in a first implementation, a computer-implemented system includes a flare monitoring system configured to ascertain quantitative data concerning flare events within a processing facility, the flare monitoring system comprising a network of flare-through elements controlled by and in passive fluid communication with one or more upstream fluid sources and each generating a data signal, the one or more upstream fluid sources being flare fluid contributors for which a quantity of flare fluid at each source is estimated by a plurality of processing modules. The computer-implemented system includes one or more processors coupled to a memory and a non-transitory computer-readable storage medium coupled to the one or more processors and storing programming instructions for execution by the one or more processors, the programming instructions instructing the one or more processors to perform operations. The operations include: determining quantitative data related to flaring events within operating facilities including one or more of oil, gas and petrochemical processing plants in a network of operating facilities, flare headers, equipment, and relief sources in which each operating facility is uniquely identified and connected to the one or more processors, where the relief sources are connected using a data signal received and processed using a processing model associated with a relief source type, size and identifications; receiving real-time flaring volume data from relief devices connected to a flare network; analyzing the real-time flaring volume data in conjunction with heat and material balance information of the relief devices; performing, based on the analyzing, a comprehensive molar balance; aggregating flaring data for components for each flare header; and providing, for display to a user in a user interface, real-time flare network monitoring information, including instantaneous component-wise flaring for each flare header in the flare network.

The foregoing and other described implementations can each, optionally, include one or more of the following features:

A first feature, combinable with any of the following features, the operations further including performing the comprehensive molar balance includes determining a total molar flow of a component at each flare header based on a summation of products of each component's mole fraction of the component at a relief source times a volumetric flow rate of the relief source obtained from the flare monitoring system.

A second feature, combinable with any of the following features, the operations further including a data historian module operable to store into memory: parameters of flare-through elements concerning a relationship between generated data signals and quantitative flaring composition at each relief source; data concerning flaring composition of the flare header; real-time signals of flaring volumes for each individual component; a contribution of flaring from every source, equipment, and plant; and data concerning flaring type (hydrocarbon, non-hydrocarbon) for every operating facility, header, plant, and device.

A third feature, combinable with any of the following features, the operations further including providing, for display to the user in the user interface, real-time emissions information for each of sulfur dioxide ($SO_2$), nitrogen dioxide ($NO_2$), carbon dioxide ($CO_2$), and methane ($CH_2$) emissions for each component of the flare network.

A fourth feature, combinable with any of the following features, the operations further including providing, for display to the user in the user interface: a graph displaying flaring composition for a selected operating facility, header, and timeframe; a graph displaying daily values of hydrocarbon flaring, non-hydrocarbon flaring, and total flaring for the selected operating facility, header, and timeframe; a table for daily values of the hydrocarbon flaring, non-hydrocarbon flaring and total flaring for the selected operating facility, header, and timeframe; a pie chart demonstrating a contribution of hydrocarbon to non-hydrocarbon for the selected operating facility, header, and timeframe; a pie chart illustrating a magnitude of flaring for each component of methane, hydrogen, ethane, and hydrogen sulfide for the selected operating facility, header, and timeframe; and a graph showing a real-time component time flaring for every flare header.

A fifth feature, combinable with any of the following features, the operations further including receiving, through the user interface, user inputs to reduce combustible fluid losses due to flaring.

A sixth feature, combinable with any of the following features, the operations further including the processing facility is commercial or industrial.

In a second implementation, a computer-implemented method includes the following. Real-time flaring volume data is received from relief devices connected to a flare network. The real-time flaring volume data is analyzed in conjunction with heat and material balance information of the relief devices. A comprehensive molar balance is performed based on the analyzing, the balancing including losses/feed percentages for each component of the flare network including the relief devices throughout the flare network. Flaring data for the components is aggregated for each flare header. Real-time flare network monitoring information, including instantaneous component-wise flaring for each flare header in the flare network is provided for display to a user in a user interface.

The foregoing and other described implementations can each, optionally, include one or more of the following features:

A first feature, combinable with any of the following features, where performing the comprehensive molar balance includes determining a total molar flow of a component at each flare header based on a summation of products of each component's mole fraction of the component at a relief source times a volumetric flow rate of the relief source obtained from a flare monitoring system.

A second feature, combinable with any of the following features, the method further including receiving, through the user interface, user inputs to reduce combustible fluid losses due to flaring.

A third feature, combinable with any of the following features, the method further including providing, for display to the user in the user interface, real-time emissions information for each of sulfur dioxide ($SO_2$), nitrogen dioxide ($NO_2$), carbon dioxide ($CO_2$), and methane ($CH_2$) emissions for each component of the flare network.

A fourth feature, combinable with any of the following features, the method further including: providing, for display to the user in the user interface, a graph displaying sour header values over time; and annotating, in the graph, time periods in which a fluctuation above a pre-determined threshold occurs the sour header values.

A fifth feature, combinable with any of the following features, the method further including providing, for display to the user in the user interface: a graph displaying flaring composition for a selected operating facility, header, and timeframe; a graph displaying daily values of hydrocarbon flaring, non-hydrocarbon flaring and total flaring for the selected operating facility, header, and timeframe; a table for daily values of the hydrocarbon flaring, non-hydrocarbon flaring and total flaring for the selected operating facility, header, and timeframe; a pie chart demonstrating a contribution of hydrocarbon to non-hydrocarbon for the selected operating facility, header, and timeframe; a pie chart illustrating a magnitude of flaring for each component of methane, hydrogen, ethane, and hydrogen sulfide for the selected operating facility, header, and timeframe; and a graph showing a real-time component time flaring for each flare header.

A sixth feature, combinable with any of the following features, the method further including storing, by a data historian module: parameters of flare-through elements concerning relationships between generated data signals and quantitative flaring composition at each relief source; data concerning flaring composition of the flare header; real-time signals of flaring volumes for each individual component; a contribution of flaring from every source, equipment, and plant; and data concerning flaring type (hydrocarbon, non-hydrocarbon) for every operating facility, header, plant and device.

In a third implementation, a non-transitory, computer-readable medium stores one or more instructions executable by a computer system to perform operations including the following. Real-time flaring volume data is received from relief devices connected to a flare network. The real-time flaring volume data is analyzed in conjunction with heat and material balance information of the relief devices. A comprehensive molar balance is performed based on the analyzing, the balancing including losses/feed percentages for each component of the flare network including the relief devices throughout the flare network. Flaring data for the components is aggregated for each flare header. Real-time flare network monitoring information, including instantaneous component-wise flaring for each flare header in the flare network is provided for display to a user in a user interface.

The foregoing and other described implementations can each, optionally, include one or more of the following features:

A first feature, combinable with any of the following features, where performing the comprehensive molar balance includes determining a total molar flow of a component at each flare header based on a summation of products of each component's mole fraction of the component at a relief source times a volumetric flow rate of the relief source obtained from a flare monitoring system.

A second feature, combinable with any of the following features, the operations further including receiving, through the user interface, user inputs to reduce combustible fluid losses due to flaring.

A third feature, combinable with any of the following features, the operations further including providing, for display to the user in the user interface, real-time emissions information for each of sulfur dioxide ($SO_2$), nitrogen dioxide ($NO_2$), carbon dioxide ($CO_2$), and methane ($CH_2$) emissions for each component of the flare network.

A fourth feature, combinable with any of the following features, the operations further including: providing, for display to the user in the user interface, a graph displaying sour header values over time; and annotating, in the graph, time periods in which a fluctuation above a pre-determined threshold occurs the sour header values.

A fifth feature, combinable with any of the following features, the operations further including providing, for display to the user in the user interface: a graph displaying flaring composition for a selected operating facility, header, and timeframe; a graph displaying daily values of hydrocarbon flaring, non-hydrocarbon flaring and total flaring for the selected operating facility, header, and timeframe; a table for daily values of the hydrocarbon flaring, non-hydrocarbon flaring and total flaring for the selected operating facility, header, and timeframe; a pie chart demonstrating a contribution of hydrocarbon to non-hydrocarbon for the selected operating facility, header, and timeframe; a pie chart illustrating a magnitude of flaring for each component of methane, hydrogen, ethane, and hydrogen sulfide for the selected operating facility, header, and timeframe; and a graph showing a real-time component time flaring for each flare header.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. For example, the signal can be a machine-generated electrical, optical, or electromagnetic signal that is generated to encode information for transmission to a suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatuses, devices, and machines for processing data, including by way of example, a programmable processor, a computer, or multiple processors or computers. The apparatus can also include special purpose logic circuitry including, for example, a central processing unit (CPU), a field-programmable gate array (FPGA), or an application-specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, such as LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub-programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory.

Graphics processing units (GPUs) can also be used in combination with CPUs. The GPUs can provide specialized processing that occurs in parallel to processing performed by CPUs. The specialized processing can include artificial intelligence (AI) applications and processing, for example. GPUs can be used in GPU clusters or in multi-GPU computing.

A computer can include, or be operatively coupled to, one or more mass storage devices for storing data. In some implementations, a computer can receive data from, and transfer data to, the mass storage devices including, for example, magnetic, magneto-optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer-readable media (transitory or non-transitory, as appropriate) suitable for storing computer program instructions and data can include all forms of permanent/non-permanent and volatile/non-volatile memory, media, and memory devices. Computer-readable media can include, for example, semiconductor memory devices such as random access memory (RAM), read-only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer-readable media can also include, for example, magnetic devices such as tape, cartridges, cassettes, and internal/removable disks. Computer-readable media can also include magneto-optical disks and optical memory devices and technologies including, for example, digital video disc (DVD), CD-ROM, DVD+/-R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated into, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that the user uses. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch-screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back-end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations. It should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system including a computer memory interoperably coupled with a hardware processor configured to perform the computer-implemented method or the instructions stored on the non-transitory, computer-readable medium.

What is claimed is:

1. A computer-implemented system, comprising:

a flare monitoring system configured to ascertain quantitative data concerning flare events within a processing facility, the flare monitoring system comprising a network of flare-through elements controlled by and in passive fluid communication with one or more upstream fluid sources and each generating a data signal, the one or more upstream fluid sources being flare fluid contributors for which a quantity of flare fluid at each source is estimated by a plurality of processing modules;

one or more processors coupled to a memory; and a non-transitory computer-readable storage medium coupled to the one or more processors and storing programming instructions for execution by the one or more processors, the programming instructions instructing the one or more processors to perform operations comprising:

determining quantitative data related to flaring events within operating facilities including one or more of oil, gas and petrochemical processing plants in a network of operating facilities, flare headers, equipment, and relief sources in which each operating facility is uniquely identified and connected to the one or more processors, wherein the relief sources are connected using a data signal received and processed using a processing model associated with a relief source type, size and identifications;

receiving real-time flaring volume data from relief devices connected to a flare network;

analyzing the real-time flaring volume data in conjunction with heat and material balance information of the relief devices;

performing, based on the analyzing, a comprehensive molar balance;

aggregating flaring data for components for each flare header; and providing, for display to a user in a user interface, real-time flare network monitoring information, including instantaneous component-wise flaring for each flare header in the flare network.

2. The computer-implemented system of claim 1, wherein performing the comprehensive molar balance includes determining a total molar flow of a component at each flare header based on a summation of products of a mole fraction of each component at a relief source times a volumetric flow rate of the relief source obtained from the flare monitoring system.

3. The computer-implemented system of claim 1, further comprising a data historian module operable to store into memory:

parameters of flare-through elements concerning a relationship between generated data signals and quantitative flaring composition at each relief source;

data concerning flaring composition of each flare header;

real-time signals of flaring volumes for each individual component;

a contribution of flaring from every source, equipment, and plant; and data concerning a flaring type for every operating facility, header, plant, and device, wherein the flaring type is one of hydrocarbon or non-hydrocarbon.

4. The computer-implemented system of claim 1, the operations further comprising:

providing, for display to the user in the user interface, real-time emissions information for each of sulfur dioxide ($SO_2$), nitrogen dioxide ($NO_2$), carbon dioxide ($CO_2$), and methane ($CH_2$) emissions for each component of the flare network.

5. The computer-implemented system of claim 1, the operations further comprising:

providing, for display to the user in the user interface:

a graph displaying flaring composition for a selected operating facility, header, and timeframe;

a graph displaying daily values of hydrocarbon flaring, non-hydrocarbon flaring, and total flaring for the selected operating facility, header, and timeframe;

a table for daily values of the hydrocarbon flaring, non-hydrocarbon flaring and total flaring for the selected operating facility, header, and timeframe;

a pie chart demonstrating a contribution of hydrocarbon and non-hydrocarbon for the selected operating facility, header, and timeframe;

a pie chart illustrating a magnitude of flaring for each component of methane, hydrogen, ethane, and hydrogen sulfide for the selected operating facility, header, and timeframe; and a graph showing a real-time component time flaring for each flare header.

6. The computer-implemented system of claim 1, further comprising:

receiving, through the user interface, user inputs to reduce combustible fluid losses due to flaring.

7. The computer-implemented system of claim 1, wherein the processing facility is commercial or industrial.

8. A computer-implemented method, comprising:

receiving real-time flaring volume data from relief devices connected to a flare network;

analyzing the real-time flaring volume data in conjunction with heat and material balance information of the relief devices;

performing, based on the analyzing, a comprehensive molar balance, including losses/feed percentages, for each component of the flare network including the relief devices throughout the flare network;

aggregating flaring data for the components for each flare header; and providing, for display to a user in a user interface, real-time flare network monitoring information, including instantaneous component-wise flaring for each flare header in the flare network.

9. The computer-implemented method of claim 8, wherein performing the comprehensive molar balance includes determining a total molar flow of a component at each flare header based on a summation of products of a mole fraction of each component at a relief source times a volumetric flow rate of the relief source obtained from a flare monitoring system.

10. The computer-implemented method of claim 8, further comprising:

receiving, through the user interface, user inputs to reduce combustible fluid losses due to flaring.

11. The computer-implemented method of claim 8, further comprising:

providing, for display to the user in the user interface, real-time emissions information for each of sulfur dioxide ($SO_2$), nitrogen dioxide ($NO_2$), carbon dioxide ($CO_2$), and methane ($CH_2$) emissions for each component of the flare network.

12. The computer-implemented method of claim 8, further comprising:

providing, for display to the user in the user interface, a graph displaying sour header values over time; and annotating, in the graph, time periods in which a fluctuation in sour value headers occurs above a pre-determined threshold.

13. The computer-implemented method of claim 8, further comprising:

providing, for display to the user in the user interface:

a graph displaying flaring composition for a selected operating facility, header, and timeframe;

a graph displaying daily values of hydrocarbon flaring, non-hydrocarbon flaring and total flaring for the selected operating facility, header, and timeframe;

a table for daily values of the hydrocarbon flaring, non-hydrocarbon flaring and total flaring for the selected operating facility, header, and timeframe;

a pie chart demonstrating a contribution of hydrocarbon and non-hydrocarbon for the selected operating facility, header, and timeframe;

a pie chart illustrating a magnitude of flaring for each component of methane, hydrogen, ethane, and hydrogen sulfide for the selected operating facility, header, and timeframe; and a graph showing a real-time component time flaring for each flare header.

14. The computer-implemented method of claim 8, further comprising:

storing, by a data historian module:

parameters of flare-through elements concerning relationships between generated data signals and quantitative flaring composition at each relief source;

data concerning flaring composition of the flare header;

real-time signals of flaring volumes for each individual component;

a contribution of flaring from every source, equipment, and plant; and data concerning a flaring type for every operating facility, header, plant, and device, wherein the flaring type is one of hydrocarbon or non-hydrocarbon.

15. A non-transitory, computer-readable medium storing one or more instructions executable by a computer system to perform operations comprising:

receiving real-time flaring volume data from relief devices connected to a flare network;

analyzing the real-time flaring volume data in conjunction with heat and material balance information of the relief devices;

performing, based on the analyzing, a comprehensive molar balance, including losses/feed percentages, for each component of the flare network including the relief devices throughout the flare network;

aggregating flaring data for the components for each flare header; and providing, for display to a user in a user interface, real-time flare network monitoring information, including instantaneous component-wise flaring for each flare header in the flare network.

16. The non-transitory, computer-readable medium of claim 15, wherein performing the comprehensive molar balance includes determining a total molar flow of a component at each flare header based on a summation of products of a mole fraction of each component at a relief source times a volumetric flow rate of the relief source obtained from a flare monitoring system.

17. The non-transitory, computer-readable medium of claim 15, the operations further comprising:

receiving, through the user interface, user inputs to reduce combustible fluid losses due to flaring.

18. The non-transitory, computer-readable medium of claim 15, the operations further comprising:

providing, for display to the user in the user interface, real-time emissions information for each of sulfur dioxide ($SO_2$), nitrogen dioxide ($NO_2$), carbon dioxide ($CO_2$), and methane ($CH_2$) emissions for each component of the flare network.

19. The non-transitory, computer-readable medium of claim 15, the operations further comprising:

providing, for display to the user in the user interface, a graph displaying sour header values over time; and annotating, in the graph, time periods in which a fluctuation in sour value headers occurs above a pre-determined threshold.

20. The non-transitory, computer-readable medium of claim 15, the operations further comprising:

providing, for display to the user in the user interface:

a graph displaying flaring composition for a selected operating facility, header, and timeframe;

a graph displaying daily values of hydrocarbon flaring, non-hydrocarbon flaring and total flaring for the selected operating facility, header, and timeframe;

a table for daily values of the hydrocarbon flaring, non-hydrocarbon flaring and total flaring for the selected operating facility, header, and timeframe;

a pie chart demonstrating a contribution of hydrocarbon and non-hydrocarbon for the selected operating facility, header, and timeframe;

a pie chart illustrating a magnitude of flaring for each component of methane, hydrogen, ethane, and hydrogen sulfide for the selected operating facility, header, and timeframe; and a graph showing a real-time component time flaring for each flare header.

* * * * *